US006056022A

United States Patent [19]

Graser

[11] Patent Number: 6,056,022

[45] Date of Patent: May 2, 2000

[54] DEVICE FOR CHANGING THE HARNESS OF A LOOM

[75] Inventor: Helmut Graser, Riederich, Germany

[73] Assignee: Genkinger Hebe- und Fordertechnik GmbH, Germany

[21] Appl. No.: 09/117,848

[22] PCT Filed: Dec. 24, 1996

[86] PCT No.: PCT/EP96/05834

§ 371 Date: Aug. 6, 1998

§ 102(e) Date: Aug. 6, 1998

[87] PCT Pub. No.: WO97/29233

PCT Pub. Date: Aug. 14, 1997

[30] Foreign Application Priority Data

Feb. 6, 1996 [DE] Germany ..... 296 01 921 U

[51] Int. Cl.[7] ..... D03J 1/00

[52] U.S. Cl. ..... 139/1 R; 28/208; 414/560

[58] Field of Search ..... 139/1 R; 28/208; 414/560

[56] References Cited

U.S. PATENT DOCUMENTS 4,373,854 2/1983 Schultheis ..... 414/911
4,573,856 3/1986 Meyer et al. ..... 28/208
5,394,596 3/1995 Lindenmuller et al. ..... 28/208
5,450,880 9/1995 Briner .
5,657,794 8/1997 Briner et al. .
5,775,380 7/1998 Roelstraete et al. ..... 139/1 R

*Primary Examiner*—Andy Falik
*Attorney, Agent, or Firm*—Pendorf & Cutliff

[57] ABSTRACT

The invention relates to a device for changing the harness of a loom. It has two bearing columns (16) arranged on a chassis, two jibs (18) which can move vertically on the columns and horizontally extendible and a device (26) o the jibs (18) to transfer head frames. The head frame transfer device (26) comprises two spaced boundary plates 932) interconnected by at least one cross-member (28) and fitted with guide rails (30) for the head frames, and two spaced bearers (34) on a transverse support (22) connected to the boundary plates 932) and which can pivot in relation to the transverse support (22) to accept and transfer the head frames. In order to adapt the article changer to different weave widths, the distance between the boundary plates (32) can b adjusted by hand or by a motor. To this end, the cross-members (28) and the transfers support (22) consist of two simultaneously actuated teles copic sections (28', 28"; 22', 22").

6 Claims, 2 Drawing Sheets

DEVICE FOR CHANGING THE HARNESS OF A LOOM

BACKGROUND OF THE INVENTION

1. Field of the Invention

The invention concerns a device for changing the harness of a loom having at least two bearing columns arranged on a chassis, with jibs vertically displaceable and preferably horizontally extendable from the bearing columns, and having a device for transfer of harness frames arranged on the jibs, which transfer device comprises two spaced apart boundary plates connected to each other via at least one cross-member, fitted with guide rails for the harness frames and with at least two bearers provided spaced apart from each other on a transverse support connected to the boundary plates and which are pivotable with respect to the transverse support for receiving and transferring the harness frames.

2. Description of the Related Art

During the changing of the harness the chassis is directed to a particular position with respect to the loom and subsequently the transfer or, as the case may be, reception is initiated by lowering of the transfer device. The harness frames are form-fittingly guided within the loom in plastic guideways. This means, that also on the side of the transfer device a high geometric precision must be maintained, in order that the harness frames can be easily introduced into the guideways of the loom. To this there is added that weavers frequently utilize looms with varying loom breadths, for which until now varying article change devices had to be employed for loading.

Beginning therewith the present invention is concerned of a task of improving the change device for harnesses of the type described in the introductory portion in such a manner, that a easy article change is possible also with different loom breadths.

SUMMARY OF THE INVENTION

The inventive solution is based on the concept of making the distance between the boundary plates adjustable, so that with one and the same article change vehicle looms with varying loom breadths can be loaded. The adjustment of the separation of the boundary plates can herein either occur by hand or by motor.

A preferred embodiment of the invention contemplates that the cross-member and the transverse support are assembled from respectively at least two simultaneously telescopable telescopic parts, wherein the telescopic parts of the cross-member and transverse support are operably connected by at least one threaded drive with each other, which are simultaneously driveable.

In the case of the motorized separation adjustment means it has been found to be advantageous, when the telescopic parts of the cross-member and transverse support or their threaded drives are driven by a step motor or servo-motor controlled via a common control device.

In order to achieve an even raising and lowering of the harness frame in the guideways of the boundary plates, there is for this purpose a synchronism driver provided between the boundary plates and the transverse support, which may include a synchronization shaft extending through the transverse support, which is adjustable in its length together with the transverse support, and is preferably telescopic.

BRIEF DESCRIPTION OF THE DRAWINGS

In the following the invention will be described in greater detail by reference to the embodiment represented in schematic manner in the figures. There are shown FIG. 1 a front view of an extendible article change device for looms.

DETAILED DESCRIPTION OF THE INVENTION

Figure 1:
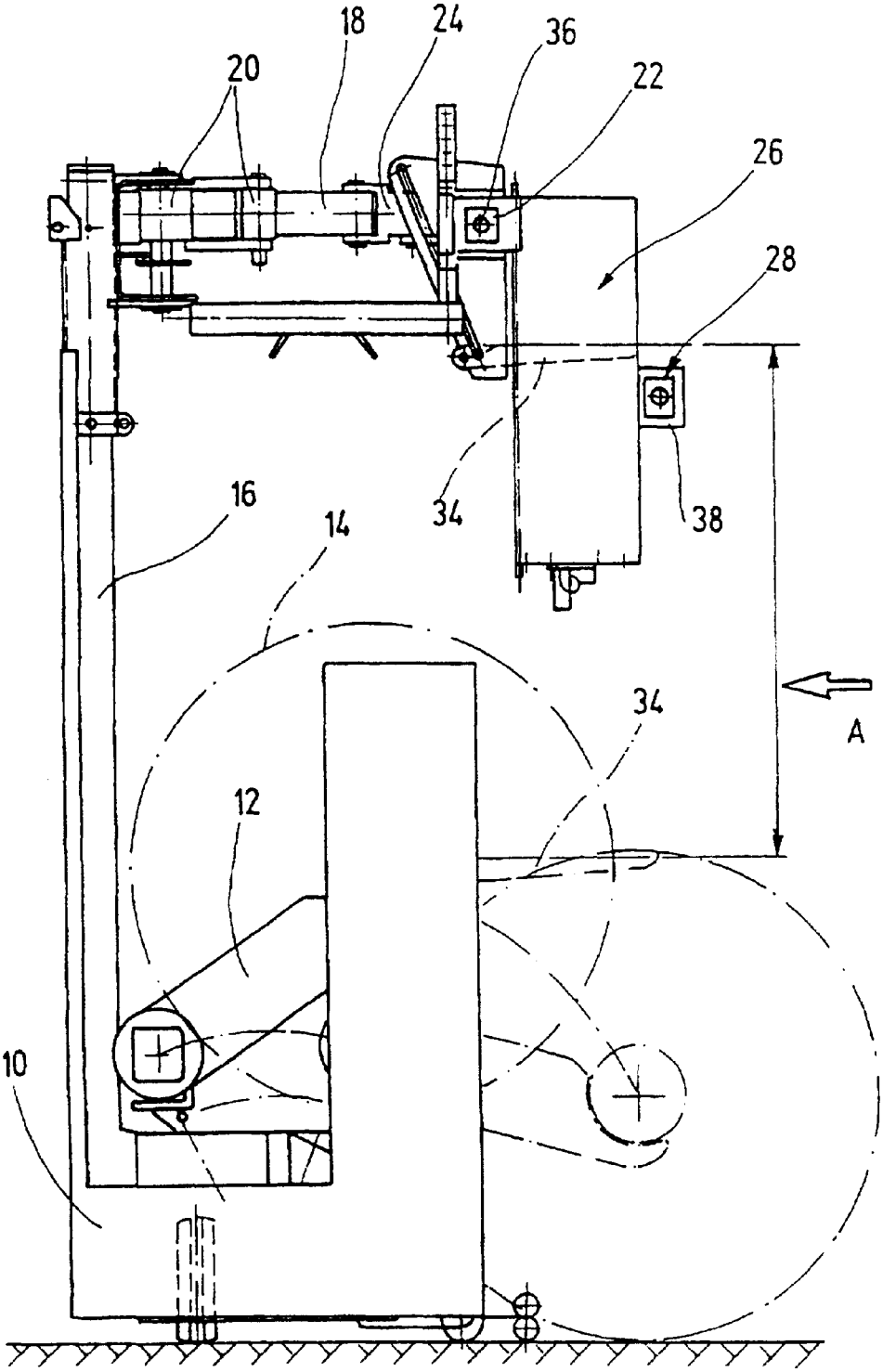
Figure 2:
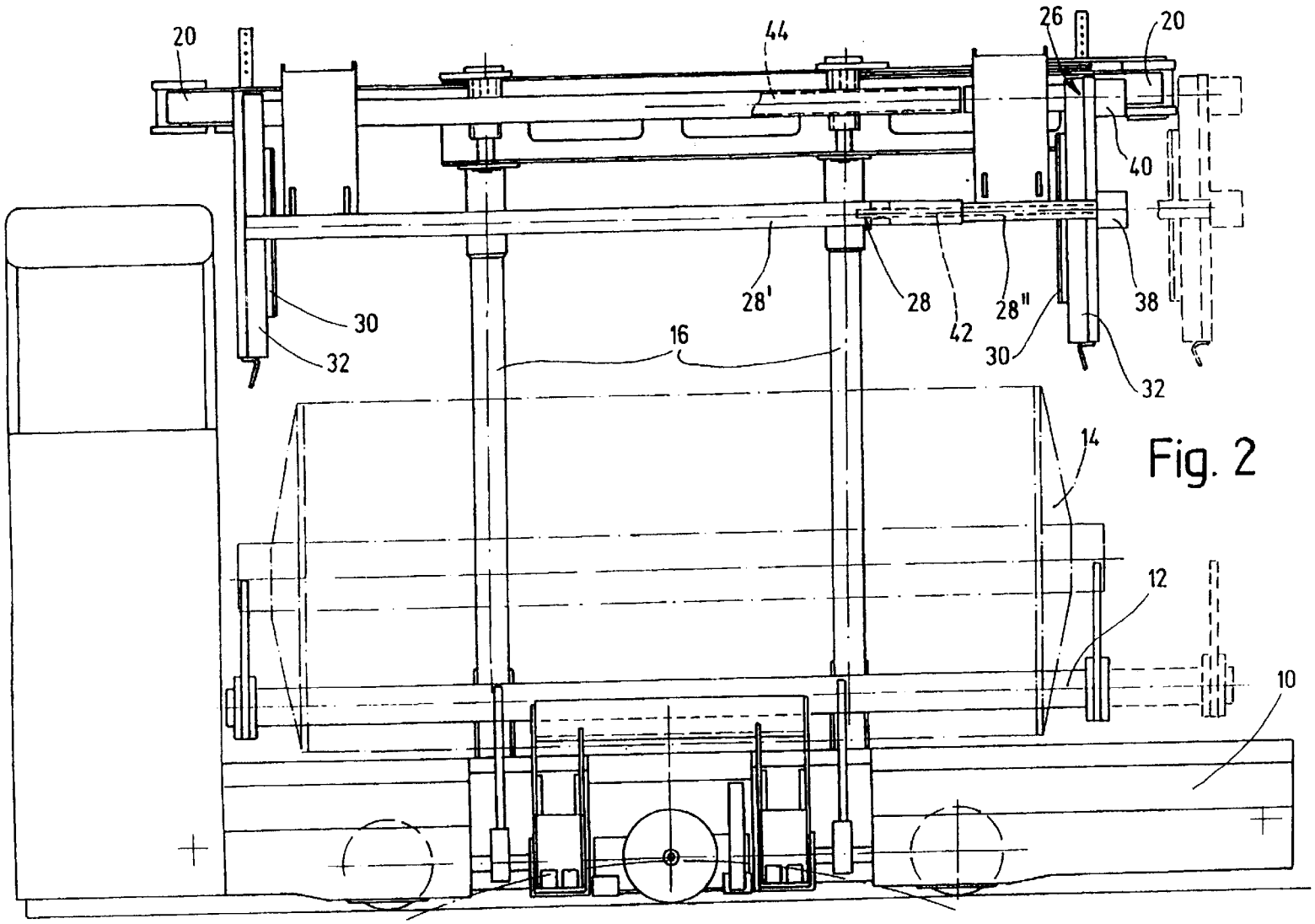
FIG. 2 a side view of the article change device according to FIG. 1 viewed in the direction of arrow A.

The mobile article change device shown in the figures is designed for the transference of a warp beam and a loom harness on a loom. The article change device includes a chassis 10 with a device 12 for transferring a warp beam 14, two bearing columns 16 mounted on the chassis 10, two jibs 18 which together with the bearing columns 16 are moveable up and down along distance A and which are extendible via the linkage or articulated joint 20, a transverse support 22 which is connected to the jibs 18 via the linkages 24 and a device 26 for transferring the—not shown—harness frames to the loom. The harness shaft transfer device 26 includes two boundary plates 32 arranged spaced apart from each other, connected to each other via a transverse cross-member 28 and provided with essentially vertically extending guide rails 30 for the head frames, and two bearers 34 provided on the transverse support 22, spaced apart from each other, and pivotable in a lever-like manner with respect to the transverse support, for receiving and transferring the head frame. The boundary plates 32 are connected to each other via an equalization drive, which is not shown in great detail, for balancing out any deviations in the plane of the boundary plates 32 during placement upon a machine-connected support. The equalization drive comprises, among other things, an equalization shaft 38, which extends through the transverse support 22 and with the transverse support 22 centrally and vertically is extendible with the boundary plates 32 to which it is connected.

Both the cross-members 28 as well also the transverse supports 22 are assembled from respectively two simultaneously telescopic telescope parts 28', 28" or as the case may be 22', 22". The telescope parts are displaceable relative to each other via respectively one step motor 38, 40 and one threaded drive 42, 44. The driving of the step motors 38, 40 occurs simultaneously via a common control device. In addition, the equilibration shaft 38 is constructed to be telescopic. With these measures it is achieved, that the intermediate space separation between the boundary plates 32 can be sized to the length of the head frames, so that one and the same article changer can be employed for supplying looms with various weave widths.

In summary the following is to be concluded: The invention is concerned with a device for changing the harness of a loom. The device includes two bearing columns associated with a chassis, two jibs 18 vertically moveable and horizontally extendible on the bearing columns, and a device 26 associated with the jibs 18 for transferring of harness frames. The harness frame transfer device 26 comprises two boundary plates 32 arranged spaced apart, connected to each other by at least one transfers member 28, having guide rails 30 for the harness frame, with two bearers 34 for receiving and transferring the harness frame provided on a transverse support 22 connected with the boundary plates 32, arranged spaced apart from each other, and pivotable with respect to the transverse support 22. In order to make possible a conformation of the article changer to various loom lengths or weave widths, the separation between the boundary plates 32 is adjustable by hand or by motor. For this the cross-member 28 and the transverse support 22 are respectively formed of two simultaneously telescopable telescopic parts (28', 28"; 22', 22').

I claim:

1. Device for transferring the harness frame of a loom, the loom including at least two bearing columns (16) provided on a chassis (10), a vertically moveable jib (18) on each of said bearing columns (16), and means for vertically moving said jibs, the device (26) for transfer of harness frames provided on said jibs, said transfer device (26) including:

two boundary plates (32) spaced apart from each other, at least one cross-member (28) connecting said boundary plates, guide rails (30) provided on said boundary plates for guiding said harness frame, and at least two bearers (34) for receiving and transferring the harness frame, said bearers provided on a transverse support (22) and connected to the boundary plates and pivot with respect to the transverse support (22), wherein the distance between the boundary plates (32) is adjustable via motor means, wherein the at least one cross-member (28) and the transverse support (22) respectively comprise at least two simultaneously telescoping parts (28', 28"; 22', 22"), and wherein a synchronous or parallel drive means is provided between the boundary plates (32) and the transverse support (22) which drive means includes a lengthwise adjustable synchronization shaft (36) which extends through the transverse support (22) and which is adjustable in length together with the transverse support (22).

2. Device according to claim 1, wherein the telescopic parts (28', 28"; 22', 22") of the cross-members (28) and the transverse support (22) are respectively connected via a threaded drive shaft (42, 44).

3. Device according to claim 1, wherein said jibs are horizontally extendible via a linkage or articulated joint (20).

4. Device for transferring the harness frame of a loom, the loom including at least two bearing columns (16) provided on a chassis (10), a vertically moveable jib (18) on each of said bearing columns (16), and means for vertically moving said jibs, the device (26) for transfer of harness frames provided on said jibs, said transfer device (26) including:

two boundary plates (32) spaced apart from each other, at least one cross-member (28) connecting said boundary plates, guide rails (30) provided on said boundary plates for guiding said harness frame, and at least two bearers (34) for receiving and transferring the harness frame, said bearers provided on a transverse support (22) and connected to the boundary plates and pivotable with respect to the transverse support (22), wherein the distance between the boundary plates (32) is adjustable via motor means, wherein the cross-member (28) and the transverse support (22) respectively comprise at least two simultaneously telescoping parts (28', 28"; 22', 22"), and wherein the telescoping parts of the at least one cross-member (28) and the transverse support (28) are driven by a step motor or servo motor controlled by a common control device.

5. Device according to claim 4, wherein said jibs are horizontally extendible via a linkage or articulated joint (20).

6. Device according to claim 4, wherein the telescopic parts (28', 28"; 22', 22") of the at least one cross member (28) and the transverse support (22) are respectively connected via a threaded drive shaft (42, 44).

* * * * *